US006105391A

United States Patent [19]

Capron

[11] Patent Number: 6,105,391

[45] Date of Patent: Aug. 22, 2000

[54] PROCESS FOR LIQUEFYING A GAS, NOTABLY A NATURAL GAS OR AIR, COMPRISING A MEDIUM PRESSURE DRAIN AND APPLICATION

[75] Inventor: Pierre Capron, Rueil Malmaison, France

[73] Assignee: Institut Francais du Petrole, Cedex, France

[21] Appl. No.: 09/216,968

[22] Filed: Dec. 21, 1998

[30] Foreign Application Priority Data

Dec. 22, 1997 [FR] France ..... 97 16275

[51] Int. Cl.[7] ..... F25J 1/00

[52] U.S. Cl. ..... 62/613; 62/619; 62/621; 62/910

[58] Field of Search ..... 62/613, 619, 621, 62/910

[56] References Cited

U.S. PATENT DOCUMENTS

| | | | |
|---|---|---|---|
| 2,900,796 | 8/1959 | Morrison | 62/613 |
| 2,903,858 | 9/1959 | Bocquet | 62/613 |
| 2,922,285 | 1/1960 | Rae | 62/613 |
| 3,116,135 | 12/1963 | Filstead, Jr. | 62/613 |
| 3,397,138 | 8/1968 | Bacon | 62/621 |
| 3,616,652 | 11/1971 | Engel | 62/613 |
| 4,456,459 | 6/1984 | Brundige, Jr. | 62/613 |
| 4,732,598 | 3/1988 | Rowles | 62/28 |

FOREIGN PATENT DOCUMENTS

| | | | |
|---|---|---|---|
| 0102087 | 3/1984 | European Pat. Off. | F25J 3/02 |
| 0599443 | 6/1994 | European Pat. Off. | F25J 1/02 |
| 2682964 | 4/1993 | France | C10L 3/12 |
| 9732172 | 9/1997 | WIPO | F25J 3/02 |

*Primary Examiner*—Ronald Capossela
*Attorney, Agent, or Firm*—Antonelli, Terry, Stout & Kraus, LLP

[57] ABSTRACT

The invention is a process for liquefying a compound A from a mixture comprising at least compound A and at least one compound B. The mixture is available at a pressure P1 with separation of the at least one compounds B and/or of compound A being performed by distillation at a pressure substantially close to pressure P2 in order to produce at least a stream mainly comprising the compound A and at least a stream F4 comprising most of the at least one compound B. The invention has an application of methane and/or helium extraction during liquefaction of a natural gas.

22 Claims, 5 Drawing Sheets

63c

82
V
68
E
D
81
83b
83a
C2
20
KX0
X0
80
82
21

PROCESS FOR LIQUEFYING A GAS, NOTABLY A NATURAL GAS OR AIR, COMPRISING A MEDIUM PRESSURE DRAIN AND APPLICATION

BACKGROUND OF THE INVENTION

1. Field of the Invention

The present invention relates to a process and to a device for liquefying a compound A from a mixture of compound A and of one or more compounds B, each one of compounds B having a lower boiling point than compound A.

2. Description of the Prior Art

The prior art describes various processes for liquefying natural gas. In most of these processes, for example those described in patents U.S. Pat. Nos.4,490,867 and 4,445,916, liquefaction comprises a refrigeration stage and a gasoline extraction stage, followed by a liquefaction stage by refrigeration of the gasoline-freed gas using a mixture of coolants circulating in a closed loop. After the liquefaction stage, the unwanted non-burning compounds such as nitrogen and/or helium are extracted by expansion after the refrigeration stage. The flash gas from the low-temperature separator placed after expansion contains most of these non-burning compounds present in the feed. It can be used as a fuel gas because it generally contains a large fraction of combustible compounds initially present. The liquid coming from the low-temperature separator constitutes the commercial LNG. The liquefied natural gas is not recycled.

The expression "unwanted non-burning compounds" refers to the compounds which lower the calorific value of the gas and whose proportion is limited in the commercial natural gas.

According to another principle, some licensors use natural gas expansion, recompression and recycling stages which are generally coupled with preliminary external refrigeration stages by means of a mixture of coolants in a closed loop, as described in patent U.S. Pat. No. 5,363,655.

During these liquefaction processes, the natural gas, which is generally prerefrigerated by a first external cycle, is expanded, after gasoline extraction, through a series a turbines, recompressed and recycled. These processes do not allow use of natural gas with a notable nitrogen or helium content. In fact, above a given content, even low quantity, the nitrogen or the helium accumulate in the recycling loop and the process thus becomes non-economical or even technically impossible to implement.

SUMMARY OF THE INVENTION

The present invention overcomes the drawbacks of the prior art by extracting the unwanted compounds during the liquefaction process. The unwanted compounds are extracted after the first expansion stage of the liquefaction process, i.e. at an average pressure value.

The method according to the invention has an application to extraction of nitrogen and/or helium during liquefaction of a natural gas comprising mainly methane.

The process according to the invention can advantageously be applied to any process for liquefying a compound A from a mixture of this compound A and of unwanted compounds B having lower boiling points than compound A.

The invention relates to a process for liquefying a compound A (methane) from a mixture comprising at least said compound A (methane) and one or more compounds B (nitrogen and/or helium), each one of the compounds B having a lower boiling point than the compound A, the mixture being available at a pressure P1, the liquefaction process comprising at least two successive expansion stages, and producing:

on the one hand, a gaseous effluent at a pressure P2 below pressure P1, having almost all of the compound(s) B and which can contain variable proportions of compound A, and on the other hand, a liquefied effluent at a pressure P3 below pressure P2, having most of the compound A and depleted in most of the compound(s) B.

The separation of the compound(s) B and/or separation of compound A is performed by distillation at a pressure substantially close to pressure P2 in order to produce at least a stream F1 comprising mainly the compound A and at least a stream F4 comprising at least the compound(s) B.

Distillation can be performed in a distillation column and reflux from the column can be generated by heat exchange between stream F2 coming from the top of the distillation column and at least one of the cold fluids recovered after later expansion stages of the liquefaction process.

For example, part of the liquid produced after the second expansion stage is used.

The value of the pressure prior to the first expansion ranges for example between 3 and 15 MPa and, after this first expansion, it ranges for example between 1 and 5 MPa.

The first expansion can be performed at a temperature value ranging between −100° C. and 0° C.

One procedure uses turbo-expanders for expansion operations.

According to an embodiment of the process, at least part of the constituent(s) extracted (B) is used as a refrigeration agent for the liquefaction process.

The liquefaction process can comprise at least 2 expansion stages and preferably 2 to 4 expansion stages.

The process according to the invention is particularly well-suited for nitrogen and/or helium (compounds B) extraction during a process for liquefying a gas such as natural gas comprising methane (compound A).

It also finds applications for argon and/or nitrogen extraction during an air liquefaction process for producing oxygen among other things.

In relation to the prior art, the method according to the invention has the advantage of liquefying a natural gas rich in nitrogen and/or helium in an open cycle, while preventing accumulation of these compounds, and by producing a medium-pressure drain stream that can feed gas turbines, the average pressure value being of the order of 3 MPa. The medium-pressure drain stream has the unwanted compounds to be extracted and of an adjustable amount of combustible gas.

BREIF DESCRIPTION OF THE DRAWINGS

Other features and advantages of the invention will be clear from reading the description hereafter of embodiments of the device according to the invention, with reference to the accompanying figures wherein:

FIGS. 1A and 1B diagrammatically illustrate the principle of the method according to the invention applied during a process for liquefying a natural gas, FIGS. 2A, 2B, 3 and 4 are used for the numerical example given.

DETAILED DESCRIPTION OF THE INVENTION

Figure 1A:
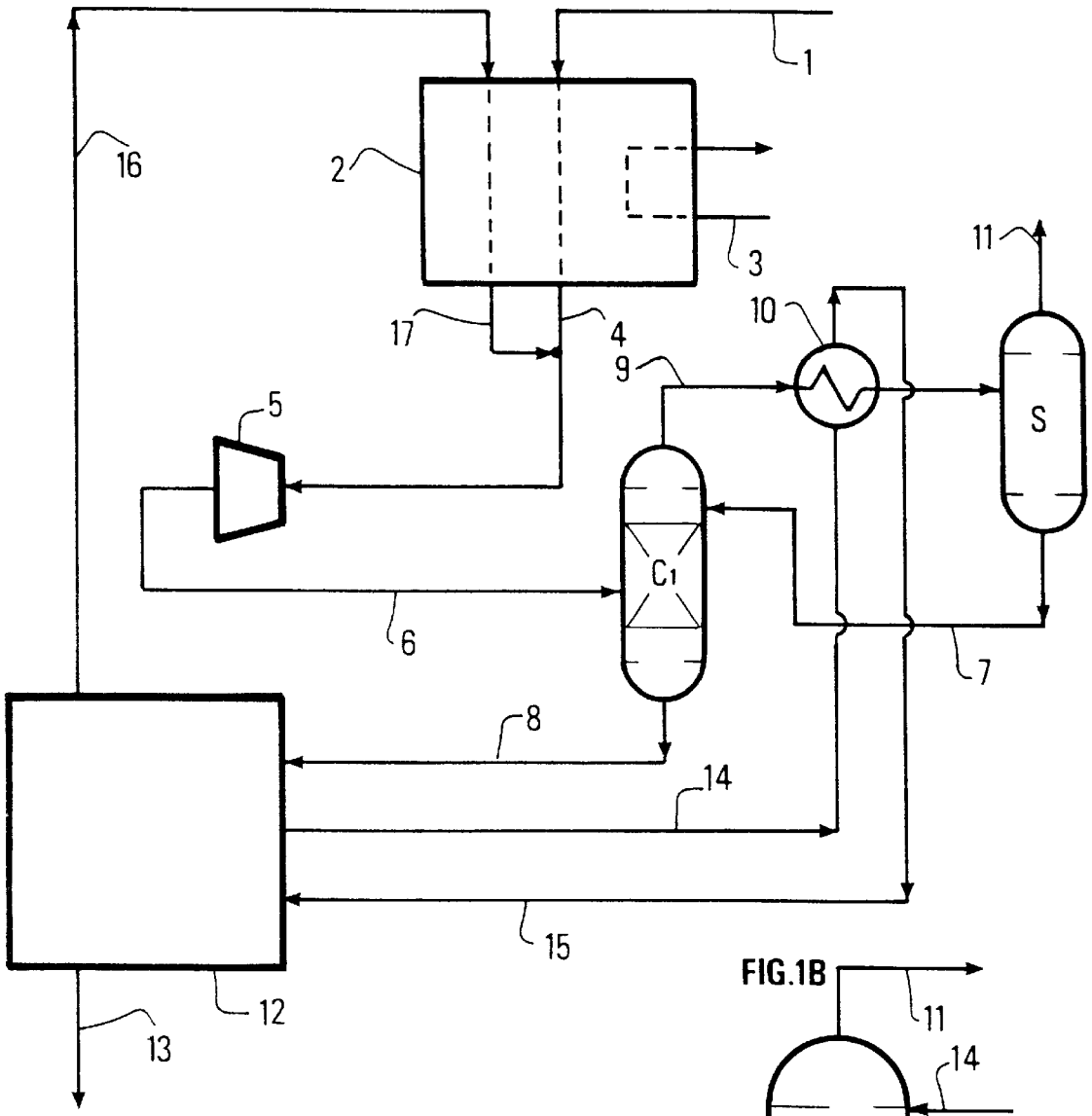

FIG. 1A diagrammatically shows an example of a device for implementing the method according to the invention of extracting the nitrogen and/or the helium which are present in notable proportions (of the order of 1 to 10% and at least 1%) in a natural gas mainly comprising methane. The extraction stage is performed at medium pressure and after the first stage of a liquefaction process.

Without departing from the scope of the invention, the method can be extended to other fluids comprising a main constituent A and unwanted constituents B which have the distinctive feature of being more volatile than the constituent of type A at bubble point.

Figure 3:
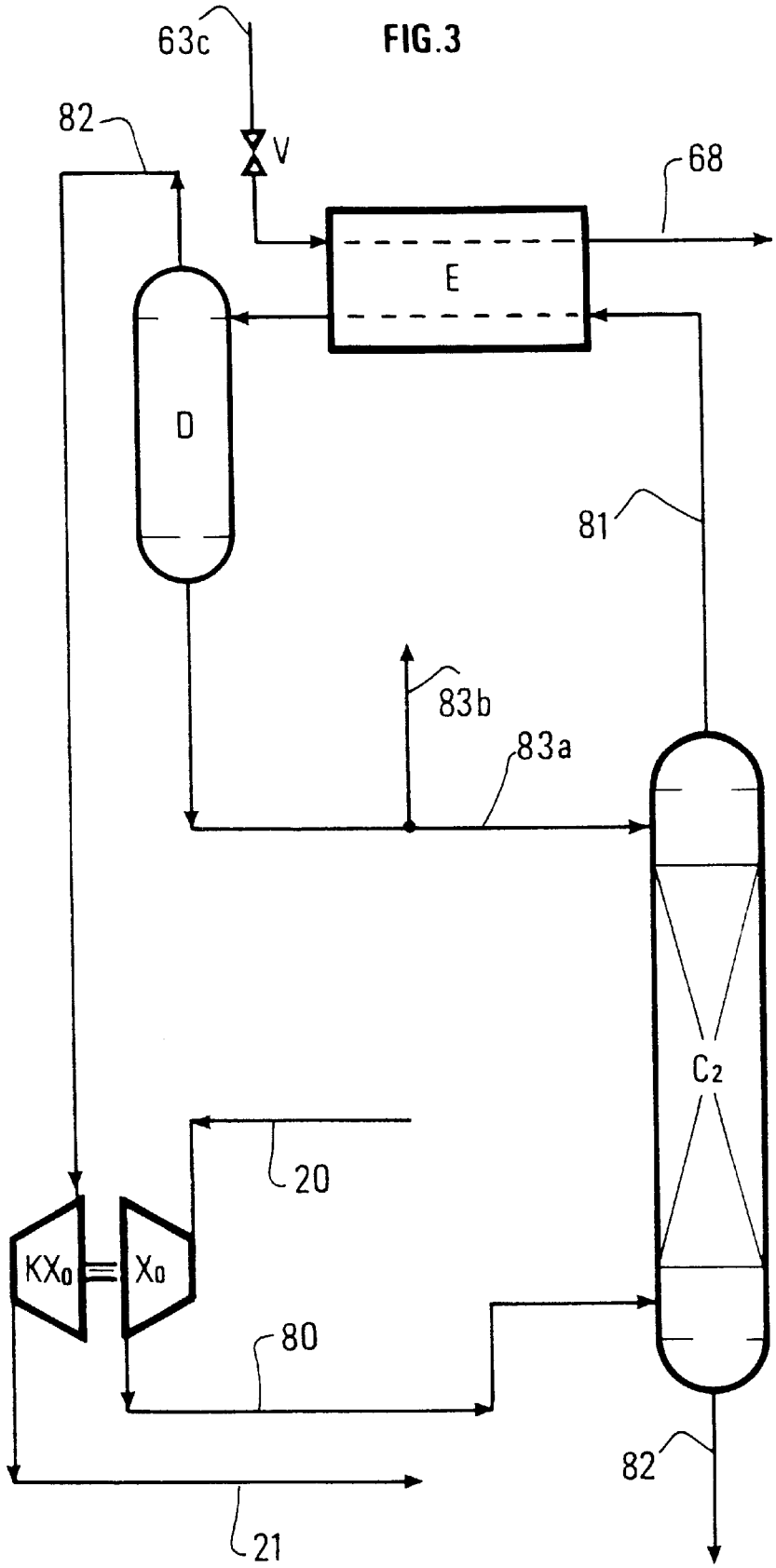

The constituents present in natural gas which are less volatile than methane are for example extracted during a gasoline extraction stage described for example in FIG. 3 and described in the article by Chen Hwa Chiu entitled "LPG recovery in baseload LNG plant" published in GASTECH 96 Vienna, 3–6 Dec. 1996, Conference papers Vol.2, Session 10.

The natural gas is fed through a line 1 into a refrigeration device 2 associated with refrigeration cycle 3. The cooled natural gas is discharged at a pressure P1 and at a temperature T1 through a line 4, then expanded through an expander S or an expansion valve to a pressure level P2 that is higher than the pressure value P3 of the liquefied natural gas discharged through a line 13 (after the liquefaction process).

The expanded natural gas is fed through a line 6 into a contactor C1 provided, at the top of a reflux delivery line 7 (third stream F3), with a discharge line 8 intended for a first stream F1 of natural gas mainly comprising methane, and with a discharge line 9 intended for a second stream F2 of methane and of most of the nitrogen and/or the helium initially present in the natural gas introduced through line 1.

The second stream F2 is cooled through a condenser 10 in order to be sent to a separator S. At the outlet of this separator, the nitrogen and/or the helium that have been separated are discharged at the top through a line 11 together with a variable amount of methane, and the third stream F3 mainly consisting of methane, which is used as reflux in contactor C1, is discharged through line 7. The mixture of nitrogen and/or of helium and of methane constitutes the drain or stream F4 which is discharged through line 11.

The first stream F1 extracted through line 8 and comprising mainly methane is sent to one or more later processing stages bearing reference number 12 in the figure, in order to obtain the natural gas in liquid form at a pressure P3. This liquefied gas is then discharged through line 13, for example to a storage tank, or sent to a feeder.

The medium-pressure method according to the invention for extracting nitrogen and/or helium from natural gas thus comprises:

- a first expansion stage (turbine 5), the natural gas being, prior to this expansion stage, at a pressure ranging between 3 and 15 MPa, and after expansion at a pressure ranging between 1 and 5 MPa for example. The temperature of the natural gas ranges between −100 and 0° C.,
- a stage of distillation (C1) of the expanded natural gas where a reflux comprising methane is used to extract the nitrogen and/or the helium from the natural gas,
- at the end of the distillation stage, a first stream F1 mostly comprising methane and a second stream F2 comprising methane and nitrogen and/or helium are obtained,
- at the end of a separation stage following the distillation stage, a stream F4 or drain stream of nitrogen and/or helium and of a variable proportion of methane is produced.

According to an embodiment, the refrigerating agent used in condenser 10 can be a natural gas fraction extracted during a later stage of the liquefaction process, which is sent to condenser 10 through a line 14 and recycled through a line 15, after heat exchange with second stream F2, to the later processing stages of the liquefaction process. Advantageously, this fraction is in the liquid form.

The rate of injection of the coolant is advantageously adjusted to control the composition of stream F4 extracted at the top of separator S and to produce a fluid whose calorific value specificities correspond to the fuel gas requirements of the LNG plant.

In case of an expansion liquefaction process, the later stages produce a gaseous fraction with the liquid phase forming the LNG or liquefied natural gas. This gaseous fraction is recycled through a line 16 to refrigeration device 2 prior to being discharged through a line 17 and mixed with the cooled natural gas discharged through line 4.

Figure 1B:
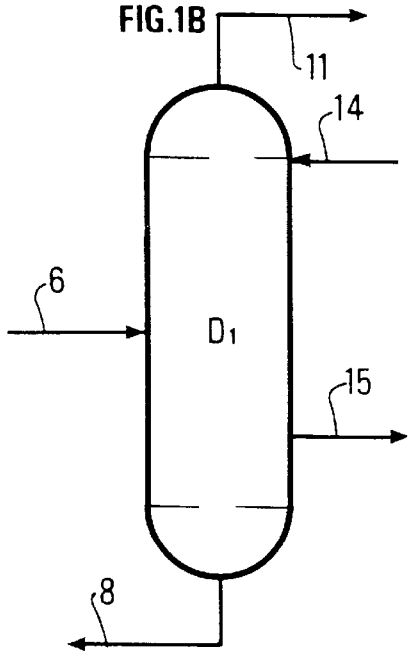

FIG. 1B diagrammatically shows a an alternative embodiment including, in a single enclosure, the contacting, condensation and separation stages corresponding to references C1, 10 and S in FIG. 1A.

A dephlegmator exchanger D1 provided with line 6, line 8 and line 11 shown in FIG. 1A is used for example.

Lines 14 and 15 allow circulation of the cooling mixture required for condensation of the methane in dephlegmator exchanger D1.

The methane in the dephlegmator exchanger condenses at least partly and flows in a descending direction, thus acting as a reflux allowing separation of the unwanted non-burning compounds of the methane.

Circulation of the refrigerating mixture can be achieved in a portion of the dephlegmator that can be concentrated in a zone at the top of the dephlegmator, or extend over most of the length thereof.

Without departing from the scope of the invention, the mixture of coolants can be replaced by any refrigeration apparatus equipping the dephlegmator.

A numerical example is given in connection with FIGS. 2A, 2B, 3 and 4 in order to illustrate the application of the method according to the invention to a natural gas liquefaction process.

Figure 2A:
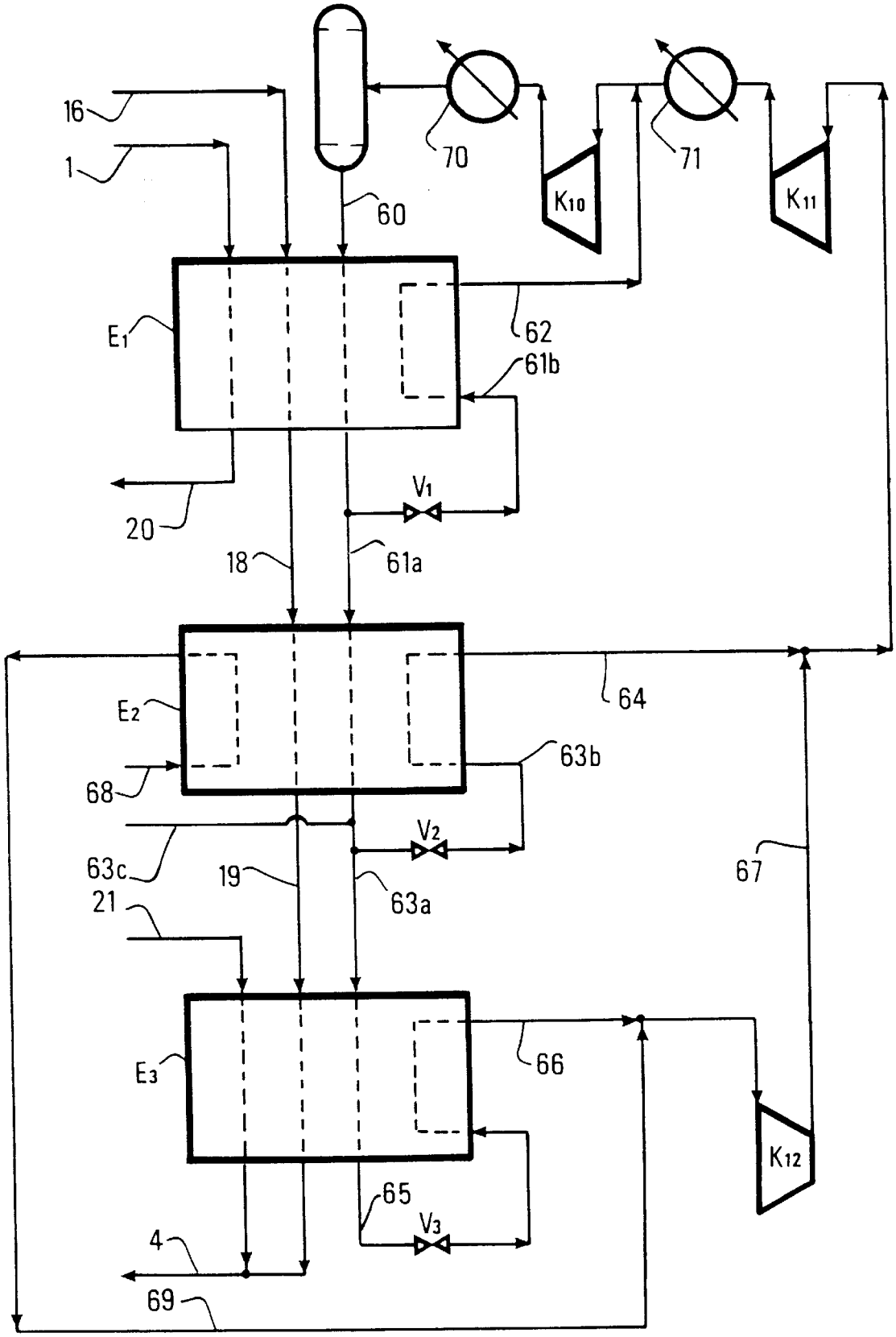
Figure 2B:
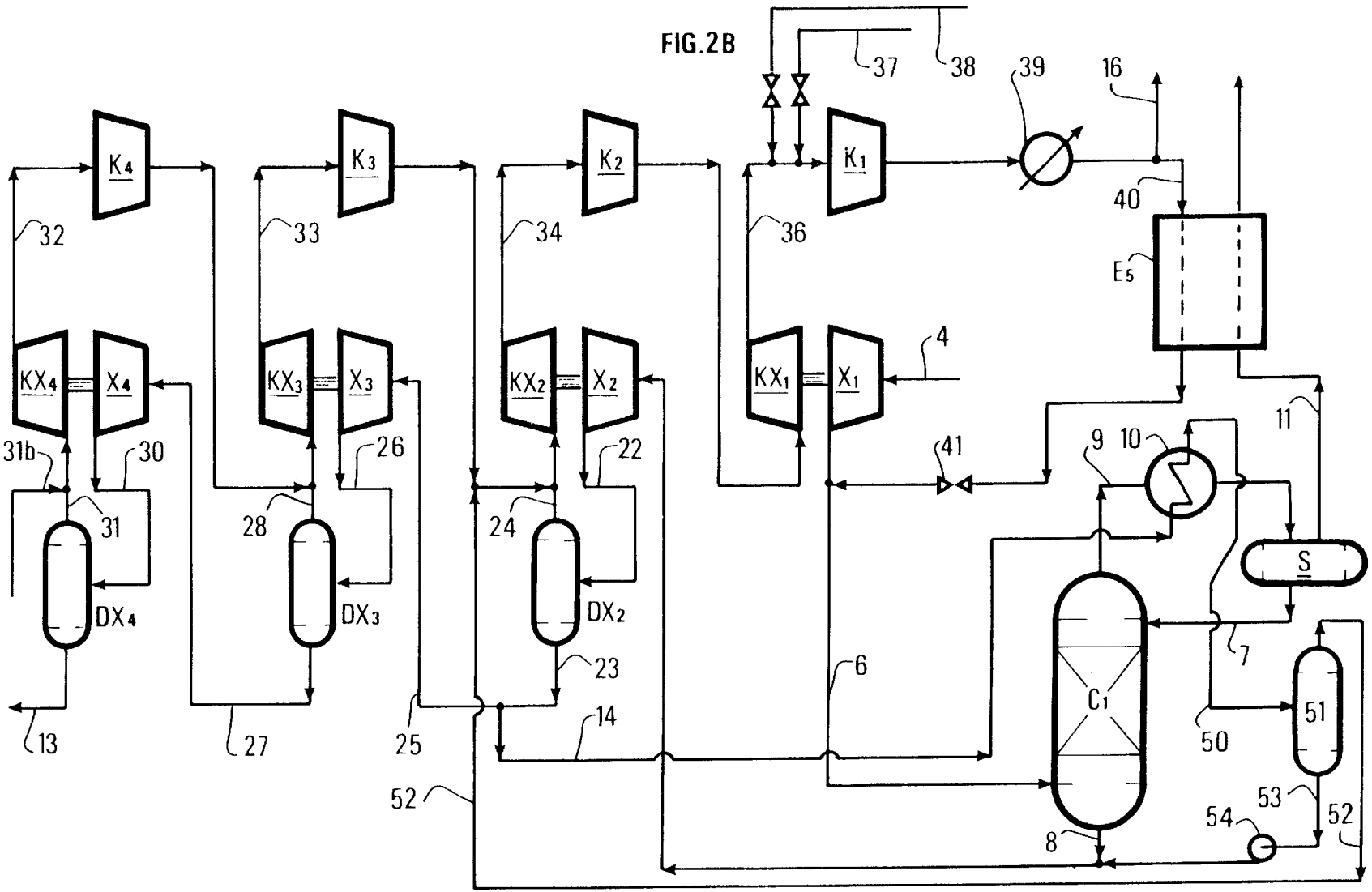
Figure 4:
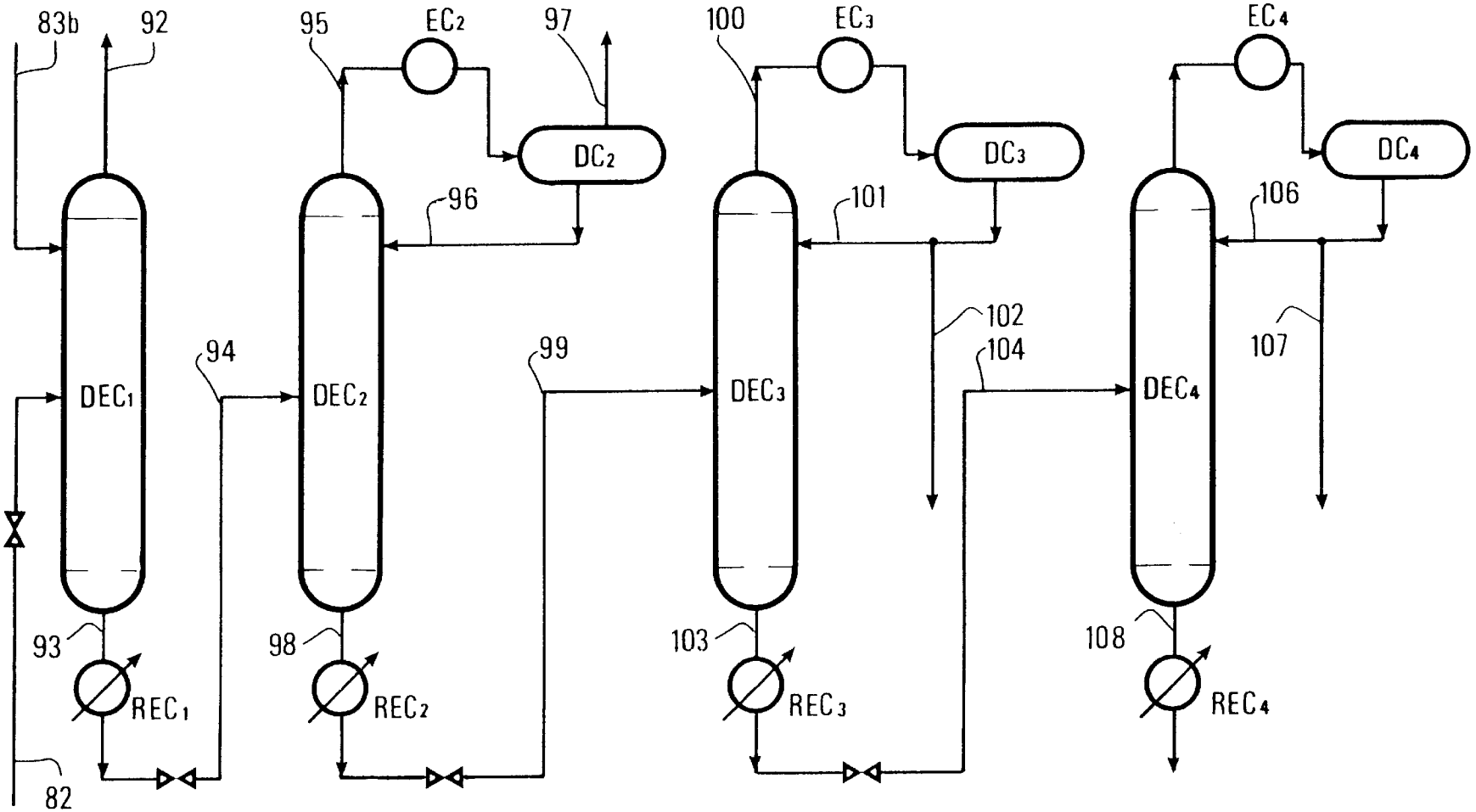

The nitrogen and/or helium extraction stage is performed for example after the first expansion stage according to the pattern of FIGS. 2A and 2B split in two for clarity reasons, and FIGS. 3 and 4 show the condensate gasoline extraction and stabilization stages.

The composition of the natural gas expressed in mole fractions is as follows:

| | |
|---|---|
| C1 | 89.42% by moles |
| N2 | 4.19 |
| C2 | 5.23 |
| C3 | 1.81 |
| iC4 | 0.35 |
| nC4 | 0.55 |
| iC5 | 0.19 |
| nC5 | 0.15 |
| nC6 | 0.11 |

Prior to being liquefied, the natural gas is processed in order to remove the water and/or the acid gases.

In this application example, refrigeration device 2 (FIG. 2A) comprises three exchangers E1, E2 and E3 arranged in series.

The natural gas is fed through line 1 into first exchanger E1 at a pressure close to 10 MPa and at a temperature of 45°

C. It flows out cooled to a temperature of about 11° C. through a line 20 and is sent to a gasoline extraction stage performed according to a pattern described in FIG. 3 and explained hereafter.

The natural gas freed from its heaviest fractions after the gasoline extraction stage is then fed through a line 21 into exchanger E3 where it is cooled to a temperature close to −70° C. It is sent through line 4, at a pressure of 9 MPa, to the constituent B extraction stage, nitrogen and/or helium in the present case.

This extraction is carried out according to a pattern substantially identical to that described in FIG. 1 by means of the stages described in FIG. 2B.

The natural gas extracted through line 4 is expanded through expansion device X1 (bearing reference number 5 in FIG. 1), for example a liquid turbine at the inlet and a two-phase gas-liquid turbine at the outlet, to a pressure that is sufficiently low to vaporize most of the nitrogen. The expanded natural gas is then sent through line 6 to contactor C1 at the outlet of which the first stream F1 comprising mostly methane in liquid form at bubble point is discharged through line 8 and the second stream F2 of at least the methane, and the nitrogen and/or the helium is discharged through line 9.

The second stream F2 flows through condenser 10 to obtain condensation of the methane which is thereafter separated from the nitrogen and/or the helium in separation S.

The liquid fraction from separator S, enriched in separated methane, is sent back to contactor C1 through line 7 to be used as reflux (stream F3), whereas the gaseous fraction enriched in nitrogen and/or helium (stream F4) is discharged through line 11 and constitutes the drain stream of the system, which can be used as fuel gas whose methane composition can be controlled and adjusted according to requirements, for example by varying the flow rate of coolant 14. Stream F4, discharged through line 11, is sent to a heat exchanger E5 where it is used as coolant prior to being discharged without being recycled to the liquefaction process.

The first stream F1 of natural gas in liquid form is sent through line 8 to a second stage of the liquefaction process comprising an expander X2 through which the first stream Fl is expanded to a pressure close to 1 MPa in order to produce a gas phase and a liquid phase. These two phases are separated in a separator DX3 at the outlet of which the liquid phase is discharged through a line 23 and the gas phase is discharged through a line 24.

The liquid phase can be separated into a first liquid fraction L1 that is sent through line 14 to condenser 10 to be used as a coolant, and a second liquid fraction L2 that is sent through a line 25 to a third stage of the liquefaction process where it is expanded through an expander X3 to a pressure of 0.3 MPa in order to produce a liquid phase and a gas phase that are sent to a drum DX3 through a line 26.

At the outlet of separator DX3, the liquid phase is extracted through a line 27 and the gas phase is extracted through a line 28.

The liquid phase is expanded in a turbine X4 (fourth stage) to a pressure of the order of 0.1 MPa selected to obtain a liquid phase and a gas phase at the storage pressure of the liquefied natural gas or LNG. These two phases are discharged through a line 30 and separated in a separator DX4 at the outlet of which the liquefied natural gas is extracted through line 13 (FIG. 1) and a gas phase is extracted through a line 31.

The boil-off produced in the LNG storage tank, not shown in the figure, can be introduced through a line 31*b* in order to be mixed with the gas phase from line 31.

The gas phase resulting from this mixing is compressed through a compressor KX4 driven by expander X4, sent through a line 32 to a compressor K4 where it is compressed to a pressure substantially close to the pressure of the gas phase discharged through line 28 of about 0.3 MPa. These two gas phases are mixed together and compressed in a compressor KX3 driven by turbine X3, then sent through a line 33 to a compressor K3 and compressed to a pressure substantially close to the pressure of the gas phase discharged through line 24. These two gas phases are mixed together with stream 52 resulting from the vaporization of coolant 14 and compressed by a compressor KX2 driven by turbine X2, sent through a line 34 to a compressor K2 where they are compressed to a pressure of the order of 3 MPa.

The gas phase from K2 is sent to a compressor KX1 driven by turbine X1 to obtain a gas phase sent through a line 36 to a compressor K1. It can be previously mixed with the gaseous fractions coming from the deethanizer and from the demethanizer (FIGS. 3 and 4) and introduced through lines 37, 38. The mixture of the three gas phases is compressed to a pressure value slightly higher than that of the gaseous stream sent through line 21 to exchanger E3 (FIG. 2A). This gaseous fraction is at least partly recycled to exchanger E1 through line 16 after cooling in a device 39. The pressure value is determined so as to compensate at least for the pressure drop generated by exchangers E1, E2 and E3, so that the main stream of natural gas introduced through line 1 and the recycle stream introduced through line 16 are substantially at the same pressure at the outlet of exchanger E3, with a temperature of the order of −70° C.

The recycle stream (16 and 40) is cooled for example by using an external heat source 39 such as water, air or any other cooling agent. It flows through the various exchangers E1, E2 and E3, and it is discharged through line 17 in order to be mixed with the natural gas coming from line 4 (FIG. 1).

Through these various exchangers, the recycle stream is successively cooled to 11° C., −29° C. and −70° C. Mixing of the stream of recycled natural gas and of the main stream of natural gas in discharge line 4 is performed at −70° C. and 9 MPa.

A minor fraction of the recycle stream can be extracted through a line 40, then cooled in a heat exchanger E5 at the outlet of which it is expanded through an expansion valve 41, for example, prior to being mixed with the stream coming from expander X1. Advantageously, in order to ensure refrigeration in exchanger E5, at least part of the cold drain stream rich in nitrogen and/or helium coming from line 11 is used.

The coolant used in condenser 10 can consist of part of the liquid withdrawn during the liquefaction process, for example at the level of the second expansion stage (X2). Part of the liquid fraction comprising methane and discharged through line 23 can be withdrawn and sent through line 14 to be used as the coolant in condenser 10. This fraction, after heat exchange with stream F2 comprising methane, nitrogen and/or helium, is sent through a line 50 to a separation device 51 at the outlet of which a gas phase is discharged at the top through a line 52 and sent to line 24 at the level of compressor KX2, and a liquid phase is discharged through a line 53 and sent to a pump 54 in order to be mixed with the liquid phase (stream F1) comprising methane and extracted through line 8, the mixture thereof being sent to expander X2.

Using a liquid coming from one of the previous stages of the liquefaction process as a coolant has the advantage of avoiding using a secondary cold cycle. Whatever the refrigeration process used, the present invention has the advantage of condensing the required methane fraction corresponding to the optimum composition of the drain stream (gaseous stream comprising nitrogen and/or helium from line 11). The optimum methane composition of the drain stream can be selected according to the amount of methane necessary for the fuel gas requirements of the liquefaction plant for example.

The external refrigeration cycle described in FIG. 2A and bearing reference number 3 in FIG. 1 comprises for example the following pattern: a liquid pressurized cooling mixture at a temperature slightly above the temperature of a cold source 70 is fed through a line 60 into exchanger E1 where it circulates cocurrent to the natural gas introduced through line 1 and to the recycled natural gas introduced through line 16.

At the outlet of first exchanger E1, the cooling mixture is separated into a first fraction M1 that is sent through a line 61*a* to the second exchanger E2 and a second fraction M2 that is expanded through an expansion valve V1 situated on line 61*b,* sent through this line to exchanger E1 where it circulates countercurrent to the natural gas and cooling mixture streams in order to cool them. After heat exchange, this second fraction is sent through a line 62 to a compressor K10.

The first fraction M1 of the cooling mixture, extracted through line 61*a,* circulates cocurrent to the recycled natural gas fraction fed through line 18 into exchanger E2. The cooling mixture is separated, after flowing through exchanger E2, into two fractions, a third fraction M3 that is sent through a line 63*a* to the third exchanger E3 and a fourth fraction M4 that is extracted through a line 63*b,* is expanded through an expansion valve V2 prior to being fed to exchanger E2 where it circulates countercurrent in order to cool the cooling mixture fraction circulating in exchanger E2 and the recycled natural gas. Another fraction M5 of the cooling mixture can be extracted through a line 63*c* to provide refrigeration of the top of the gasoline extraction column (FIG. 3).

The fourth cooling mixture fraction M4 obtained after heat exchange in exchanger E2 is sent through a line 64 to a compressor K11, then it is mixed, after cooling in a device 71, with the second fraction M2 from line 62 prior to being sent to compressor K10.

The third cooling mixture fraction M3 introduced through line 63*a* circulates cocurrent in exchanger E3 with the recycled gas extracted from exchanger E2 through a line 19 and the natural gas introduced through line 21 and coming from the gasoline extraction stage (FIG. 3). It is then discharged from this exchanger E3 through a line 65, expanded through an expansion valve V3 and circulated countercurrent in order to cool the two natural gas streams and the third coolant fraction. After heat exchange, the cooling mixture is discharged through a line 66 and sent to a compressor K12, then to compressor K11 through a line 67.

The coolant from line 66 can first be mixed with the coolant fraction coming from the top of the gasoline extraction condenser (FIG. 3), which is fed into exchanger E2 through a line 68, it circulates in this exchanger countercurrent to the streams to be refrigerated and is extracted through a line 69. This mixture of the two coolant fractions is compressed in compressor K12 and compressors K11 and K10, and it is cooled by external sources 70 and 71.

A complete process computation made by means of a software used in the chemical engineering field has checked the performance of the extraction method according to the invention.

Initial data

The natural gas, previously dehydrated and deacidified, occurs in the following conditions:

| Compound | Mole fraction |
|---|---|
| C1 | 0.8742 |
| N2 | 0.0419 |
| C2 | 0.0523 |
| C3 | 0.0181 |
| iC4 | 0.0035 |
| nC4 | 0.0055 |
| iC5 | 0.0019 |
| nC5 | 0.0015 |
| nC6 | 0.0011 |
| Flow rate | 10,850 kmol/h |
| Pressure | 10 MPa |
| Temperature | 45° C. |

Precooling temperature before expansion: −70° C.

Performances:

Energy consumption: 1,175 kJ/kg of LNG produced (ratio of the compression power to the flow rate of LNG produced)

Compression power: 55,355 kW

Products obtained

LNG at the end of the liquefaction process

| Compound | Mole fraction |
|---|---|
| C1 | 0.9185 |
| N2 | 0.0005 |
| C2 | 0.0585 |
| C3 | 0.0180 |
| iC4 | 0.0022 |
| nC4 | 0.0023 |
| iC5 | 0.0000 |
| nC5 | 0.0000 |
| nC6 | 0.0000 |
| Flow rate | 9,660 kmol/h |
| Pressure | 0.1 MPa |
| Temperature | −161.0° C. |

Drain stream of nitrogen and/or helium to be extracted

| Compound | Mole fraction |
|---|---|
| C1 | 0.5504 |
| N2 | 0.4496 |
| C2 | 0.0000 |
| C3 | 0.0000 |
| iC4 | 0.0000 |
| nC4 | 0.0000 |
| iC5 | 0.0000 |
| nC5 | 0.0000 |
| nC6 | 0.0000 |
| Flow rate | 1,000 kmol/h |
| Pressure | 3.16 MPa |
| Temperature | 33° C. |

These performances take into account the boil-off recompression. It should be noted that the fuel gas pressure allows processing to occur without a fuel gas compressor before feeding gas turbines. The drain stream is absolutely free of heavier products than methane (no condensation risk in the burners).

The fuel gas flow rate can be controlled by varying the flow rate of the coolant that circulates in the condenser.

Supposing that the fuel gas flow rate required in the liquefaction plant is 1,300 rather than 1,000 kmol/h, the design differences are as follows:

Performances:

Energy consumption: 1,174 kJ/kg of LNG produced (ratio of the compression power to the flow rate of LNG produced)

Compression power: 53,740 kW

Products obtained

LNG

| Compound | Mole fraction |
|---|---|
| C1 | 0.9159 |
| N2 | 0.0005 |
| C2 | 0.0604 |
| C3 | 0.0186 |
| iC4 | 0.0023 |
| nC4 | 0.0023 |
| iC5 | 0.0000 |
| nC5 | 0.0000 |
| nC6 | 0.0000 |
| Flow rate | 9,359 kmol/h |
| Pressure | 0.1 MPa |
| Temperature | −161.0° C. |

Drain stream consisting of the nitrogen and/or helium to be extracted

| Compound | Mole fraction |
|---|---|
| C1 | 0.6540 |
| N2 | 0.3460 |
| C2 | 0.0000 |
| C3 | 0.0000 |
| iC4 | 0.0000 |
| nC4 | 0.0000 |
| iC5 | 0.0000 |
| nC5 | 0.0000 |
| nC6 | 0.0000 |
| Flow rate | 1,300 kmol/h |
| Pressure | 3.16 MPa |
| Temperature | 33° C. |

The LNG plant is little sensitive to a large variation in the drain stream flow, which allows a good operating flexibility.

FIG. 3 briefly describes a pattern allowing the stage of gasoline extraction from the natural gas precooled in exchanger E3 to be carried out.

The natural gas precooled to 11° C. and discharged through line 20 comprises heavy fractions. It is expanded through a turbine X0 to a pressure of the order of 5.2 MPa, the two-phase stream thus produced being at a temperature of about −28° C.

The two-phase stream is fed through a line 80 into a column C2 without reboiler but with a condenser. At the bottom of the column, a stream comprising condensates is extracted through a line 82 and sent to a stabilization stage described in FIG. 4. The vapour fraction of the two-phase stream circulates upwards in column C2 where it is contacted countercurrent with a reflux introduced through a line 83*a*. This reflux is generated in partial condenser E by circulating the stream coming from the top of column C2 through line 81 countercurrent to a coolant that can come from the prerefrigeration cycle described in FIG. 2A, introduced through line 63*c* and expanded through a valve V prior to flowing through E. The heated coolant, after exchanging its calories, is sent back to the prerefrigeration cycle in exchanger E2 (FIG. 2A) in order to release its heat, then it is discharged from this exchanger through line 69 and recompressed in exchanger K12 (FIG. 2A) after being mixed with the main coolant.

The stream at the top of column C2, refrigerated in E, produces a two-phase fluid that is sent to a separation D at the outlet of which a vapour fraction is extracted through a line 82 and sent to compressor KX0, while a liquid fraction is discharged at the bottom of drum D through a line 83 that divides into two sub-lines 83*a* and 83*b*. A major liquid fraction is sent through line 83*a* to be used as reflux in column C2 and the rest is sent through line 83*b* to the stabilization stage described in FIG. 4.

The major vapour fraction is compressed to a pressure of about 8.7 MPa at a temperature of the order of −13° C. prior to being sent to exchanger E3 (FIG. 2A) to be cooled and condensed.

FIG. 4 shows a device which stabilizes the condensates.

The bottom of gasoline extraction column C2 extracted through line 82 (FIG. 3) is expanded to a pressure of 4.8 MPa and sent to a demethanization column DEC1. The reflux in this column is provided by the liquid coming from line 83*b* that has been expanded. At the top of the column, a stream mainly of methane, nitrogen and ethane at −40° C. is extracted through a line 92 and sent to the process recycle described in FIG. 2A through line 37 (FIG. 2B). The product at the bottom of the column is discharged through a line 93, cooled through a device REC1 prior to being expanded, through a valve for example, to a pressure substantially equal to 3.9 MPa and sent through a line 94 to a second deethanization column DEC2. The stream flowing from the top of column DEC2 through a line 95 is partly condensed in a condenser EC2 by means of a cold utility at a temperature close to 50° C., slightly higher than the temperature of the cold source of the system (water, air or other). The two-phase mixture produced by the condensation is separated in a drum DC2 at the outlet of which the liquid phase is extracted through a line 96 in order to be used as reflux in column DEC2, and the vapour phase mainly of ethane is extracted through a line 97 and sent to the process recycle (line 38, FIG. 2B). A non-significant fraction of this vapour phase is periodically withdrawn to compensate for the ethane losses of the main refrigeration cycle and introduced at 60 for example.

The column bottom is discharged through a line 98 prior to being cooled in REC2 and expanded through a valve to a pressure substantially close to 1.5 MPa, then sent to a depropanization column DEC3 through a line 99. The stream coming from the top of this column through a line 100 is condensed in a condenser EC3 by means of a cold utility at a temperature of 50° C. slightly above the temperature of the cold source of the system (water, air or other). The liquid coming from the condenser is separated in a separator DC3 to produce a first liquid fraction discharged through a line 101 in order to be used as reflux in column DC3 and a second liquid fraction that is discharged through a line 102 to a commercial propane storage tank. A non-significant fraction of this stream is periodically withdrawn in order to compensate for the propane losses of the main refrigeration cycle.

The column bottom is discharged through a line 103 in order to be cooled by a device REC3 and expanded through a valve to a pressure close to 0.5 MPa prior to being sent, through a line 104, to a debutanization column DEC4. The stream at the top of the column is extracted through a line 105, then condensed in a condenser EC4 by means of a refrigeration source at a temperature close to 50° C. slightly higher than the temperature of the refrigeration source of the system (water, air or other). The liquid is then separated in a drum DC4 into a first liquid fraction sent through a line 106 to be used as reflux in column DC4 and a second fraction extracted through a line 107 that is sent to a commercial butane storage tank. A non significant fraction of this stream is periodically withdrawn to compensate for the butane losses of the main refrigeration cycle. The bottom of the debutanization column extracted through a line 108 is cooled through REC4 and can be sent to a condensate storage tank (light gasoline).

What is claimed is:

1. A process for liquefying a compound A from a mixture comprising at least compound A and at least one compound B, each one of the at least one compound B having a lower boiling point than the compound A and the mixture being at a pressure P1, the liquefaction process comprising:

producing by expansion a gaseous effluent at a pressure P2 lower than P1 of a majority of the at least one compound B and a liquefied effluent at a pressure P3 lower than P2 of a majority of the compound A and substantially depleted of the at least one compound B; and separating by distillation at least one of the at least one compound B and compound A at a pressure close to pressure P2 which produces at least a stream substantially comprising the compound A and a stream comprising a majority of the at least one compound B.

2. A process in accordance with claim 1 wherein:

separation is performed of each of the compound A and at least one of the compound B.

3. A process is claimed in claim 2, wherein:

the distillation is performed in a column which provides a condensed stream comprising at least one compound B and a part of the compound A and producing another stream including compound A and a majority of the at least one compound B with at least part of the another stream being used as reflux.

4. A process as claimed in claim 3, wherein:

the distillation is performed in a distillation column and;

the reflux is generated by heat exchange between a stream from the distillation column and at least one cold fluid is recovered after an expansion involved with the liquefied effluent.

5. A process as claimed in claim 4, wherein:

the at least one cold fluid recovered after expansion occurs in a liquid form at a bubble point.

6. A process as claimed in claim 2, wherein:

a value of the pressure before a first expansion ranges between 3 and 15 MPa and between 1 and 5 MPa after the first expansion.

7. A process as claimed in claim 2, wherein:

the first expansion is performed at a temperature ranging between −100° C. and 0° C.

8. A process as claimed in claim 2, further comprising:

using turbo-expanders to provide the expansion.

9. A process is claimed in claim 1, wherein:

the distillation is performed in a column which provides a condensed stream comprising at least one compound B and a part of the compound A and producing another stream including compound A and a majority of the at least one compound B with at least part of the another stream being used as reflux.

10. A process as claimed in claim 9, wherein:

the distillation is performed in a distillation column and;

the reflux is generated by heat exchange between a stream from the distillation column and at least one cold fluid is recovered after an expansion involved with the liquefied effluent.

11. A process as claimed in claim 10, wherein:

the at least one cold fluid recovered after expansion occurs in a liquid form at a bubble point.

12. A process as claimed in claim 10, wherein:

a value of the pressure before a first expansion ranges between 3 and 15 MPa and between 1 and 5 MPa after the first expansion.

13. A process as claimed in claim 10, wherein:

the first expansion is performed at a temperature ranging between −100° C. and 0° C.

14. A process as claimed in claim 9, wherein:

a value of the pressure before a first expansion ranges between 3 and 15 MPa and between 1 and 5 MPa after the first expansion.

15. A process as claimed in claim 9, wherein:

the first expansion is performed at a temperature ranging between −100° C. and 0° C.

16. A process as claimed in claim 1, wherein:

a value of the pressure before a first expansion ranges between 3 and 15 MPa and between 1 and 5 MPa after the first expansion.

17. A process as claimed in claim 1, wherein:

the first expansion is performed at a temperature ranging between −100° C. and 0° C.

18. A process as claimed in claim 1, wherein:

the mixture is refrigerated by using an external coolant before the expansion.

19. A process as claimed in claim 1 wherein:

the mixture is refrigerated by using an external coolant after the expansion.

20. A process as claimed in claim 1 wherein:

at least part of the separated stream comprising a majority of at least one compound B is used as a refrigeration agent for the liquified effluent.

21. A process as claimed in claim 1 wherein:

methane is compound A and one of nitrogen or helium are the at least one compound B.

22. An application of the process of claim 1 comprising:

extracting at least one of argon or nitrogen during liquefying air.

* * * * *